United States Patent [19]

Merchant

[11] Patent Number: 4,510,479

[45] Date of Patent: Apr. 9, 1985

[54] PC-BOARD MOUNTED THERMAL BREAKER

[75] Inventor: Donald K. Merchant, Cambridge, Md.

[73] Assignee: Airpax Corporation, Cambridge, Md.

[21] Appl. No.: 550,462

[22] Filed: Nov. 10, 1983

Related U.S. Application Data

[63] Continuation-in-part of Ser. No. 480,285, Mar. 30, 1983, abandoned.

[51] Int. Cl.[3] ..... H01H 61/00; H01H 71/16

[52] U.S. Cl. ..... 337/91; 337/56; 337/66; 337/372

[58] Field of Search ..... 337/66, 89, 91, 94, 337/365, 367, 368, 372, 56

[56] References Cited

U.S. PATENT DOCUMENTS

| | | | |
|---|---|---|---|
| 1,873,231 | 8/1932 | Werner . | |
| 1,952,129 | 3/1934 | Hardman | 337/91 |
| 2,086,755 | 7/1937 | Werner . | |
| 2,262,205 | 11/1941 | Schachtner . | |
| 2,408,873 | 10/1946 | Osterheld . | |
| 2,488,818 | 11/1949 | Kitman . | |
| 2,489,391 | 11/1949 | Thomson . | |
| 2,519,629 | 8/1950 | Bourne . | |
| 2,859,305 | 11/1958 | Happe, Jr. . | |
| 2,911,503 | 11/1959 | Garbers . | |
| 3,176,098 | 3/1965 | Watson . | |
| 3,187,145 | 6/1965 | Grabinski . | |
| 3,337,702 | 8/1967 | Brevick et al. . | |
| 3,400,234 | 9/1968 | Long . | |
| 3,405,243 | 10/1968 | Cherry et al. . | |
| 3,407,276 | 10/1968 | Pescetto . | |
| 3,413,583 | 11/1968 | Clark et al. . | |
| 3,846,729 | 11/1974 | Sorimachi . | |
| 4,325,046 | 4/1982 | Burch . | |

FOREIGN PATENT DOCUMENTS

| | | |
|---|---|---|
| 245150 | 12/1925 | United Kingdom . |
| 852427 | 10/1960 | United Kingdom . |
| 864828 | 4/1961 | United Kingdom . |

*Primary Examiner*—Harold Broome

*Attorney, Agent, or Firm*—Saidman, Sterne Kessler & Goldstein

[57] ABSTRACT

A PC-board mounted thermal breaker that opens with a snap action is disclosed. A bimetallic element, connected to the load terminal of the thermal breaker, rests on an insulated sawtooth surface when the breaker is in the closed position. A contact blade, connected to the line terminal of the breaker, is pivotably biased downward into electrical contact with the bimetallic element by the action of an overcenter spring. An overcurrent through the breaker heats the bimetallic element directly and causes it to bend upwardly, forcing the contact blade to pivot against the bias of the spring. When the contact blade has pivoted sufficiently to move the spring overcenter, the direction of spring bias reverses, pivoting the contact blade rapidly upward, and thereby opening the breaker with a snap action.

28 Claims, 11 Drawing Figures

FIG. 1
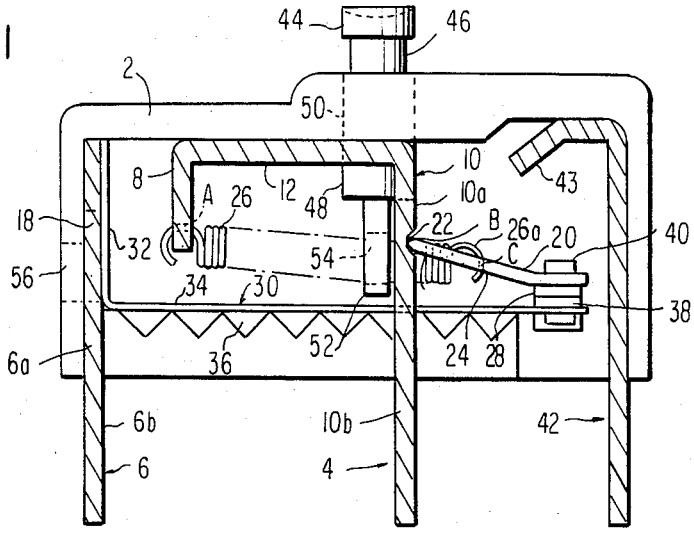
FIG. 2
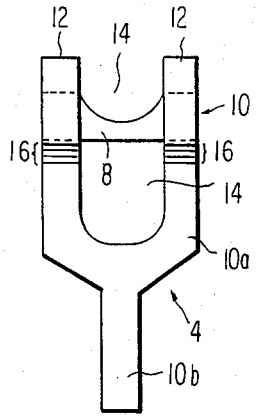
FIG. 3
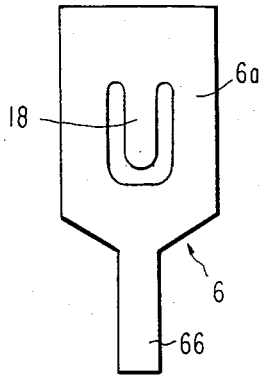
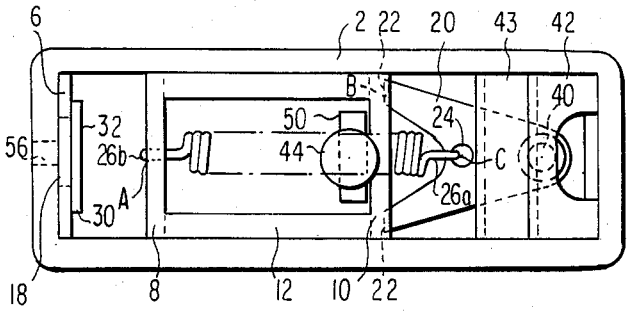
FIG. 4
FIG. 5
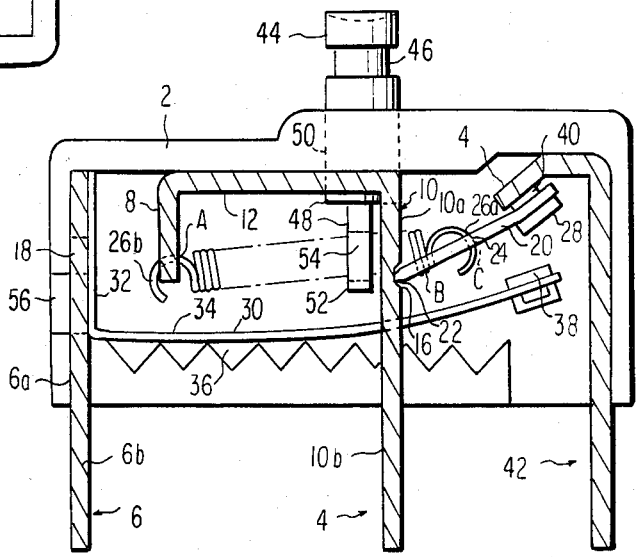

PC-BOARD MOUNTED THERMAL BREAKER

CROSS-REFERENCE TO RELATED APPLICATIONS

This is a continuation-in-part of U.S. patent application Ser. No. 480,285, filed Mar. 30, 1983, now abandoned.

BACKGROUND OF THE INVENTION

This invention relates to snap action electrothermally actuated circuit breakers. More particularly, the invention relates to improved circuit breaker mechanisms for use in compact snap action breakers combining the functions of switches and circuit breakers.

A compact snap action circuit breaker is disclosed in U.S. Pat. No. 2,911,503 issued Nov. 3, 1959 to Helmut Garbers. Garbers discloses a safety switch which, in the ON or CLOSED position, establishes a circuit through a bimetallic element, a pair of contacts, and a lever. When the bimetallic element is heated by an overcurrent, it deflects the lever past the center line of an overcenter spring. The switch then snaps open.

In circuit breakers such as disclosed by Garbers, however, the bimetallic elements are generally suspended in air. Reactive elements, therefore, tend to bend the bimetallic element downward, in the opposite direction to that required for tripping of the circuit. Furthermore, breakers such as described in the Garbers patent use separate heater and heating elements to heat the bimetal. Finally, in known circuit breakers, adjustment of the breaker is usually made via an imprecise calibration screw.

SUMMARY OF THE INVENTION

The present invention, described with respect to the appended drawings and the detailed description of the preferred embodiments below, provides new and improved electrothermally actuated circuit breaker mechanisms. The invention comprises a thermal circuit breaker with a low mass thermal element which heats and cools quickly, thus providing a faster trip time than known breakers, without the need of an auxiliary heater.

In the present invention, the thermal element is supported by the insulated housing of the breaker. The bimetallic element of the present invention is heated directly by the flow of the current being monitored. The current rating of the present invention may be accurately adjusted by stepping a pin through an aperture in the circuit breaker housing.

The circuit breaker of the present invention is particularly well suited for low current applications. Since power is a function of thickness, the present invention advantageously includes a thin bimetallic element, permitting accurate and sensitive operation of the unit at very low currents.

The thin bimetallic blade in the present invention also acts like a spring providing a flexing action against the starting friction; in essence, the bimetallic blade stores mechanical energy which assists the temperature related bending forces in the bimetallic material in tripping the circuit. Once the starting friction has been overcome, the circuit opens as though a spring has been released.

The small size of the circuit breaker of the present invention provides for better mounting on a PC board with semiconductor elements than known circuit breakers. The compact design of the present invention saves space, a critical consideration in choosing components for PC boards, where space is at a premium.

A second embodiment of the invention provides a multipole circuit breaker which opens two or more circuits in response to an overcurrent through any one of the circuits.

A third embodiment of the invention provides a dual contact breaker mechanism.

Other features and advantages of this invention will be apparent from the following description of the preferred embodiments.

BRIEF DESCRIPTION OF THE DRAWINGS

FIG. 1 is a cut-away side view of the snap action PC-board mounted thermal breaker showing the breaker mechanism of this invention in the contacts-closed position;

FIG. 2 is an end view of the line terminal in the snap action PC-board mounted thermal breaker;

FIG. 3 is an end view of the load terminal in the snap action PC-board mounted thermal breaker;

FIG. 4 is a top view of the snap action PC-board mounted thermal breaker with the top of the case removed;

FIG. 5 is a cutaway side view of the snap action PC-board mounted thermal breaker showing the breaker mechanism in the contacts-open position;

DESCRIPTION OF THE PREFERRED EMBODIMENT

Figure 6:
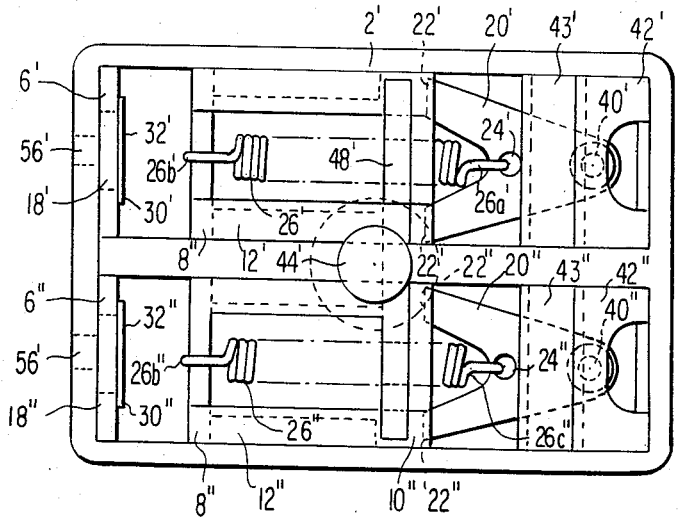
FIG. 6 is a top view of the second embodiment of the present invention as a multipole breaker mechanism.

FIGS. 1–5 show a first embodiment of the snap action thermal breaker of this invention. Referring to FIG. 1, the thermal breaker includes a housing 2 of insulating material, e.g., molded plastic. A line terminal 4 and a load terminal 6 are mounted in housing 2. In the embodiment shown, line terminal 4 is a U-shaped conductor. Terminal 4 has a short leg 8, a long leg 10, and a bridging portion 12. Leg 10 has a portion **10*a* disposed within housing 2, and a portion 10*b* which extends through housing 2 for connection to an external electrical circuit to be protected. As shown in FIG. 2, terminal 4 has an elongated slotted opening 14 that extends from leg 10, across bridging section 12, to leg 8. Line terminal 4 also includes a pair of notches 16 located midway on the two parallel sections of leg portion 10*a***.

Load terminal 6 advantageously is a straight conductor. In the disclosed embodiment, the portion **6*a* of terminal 6 inside housing 2 is wider than the portion 6*b* extending out of the housing. A tab 18, shown in FIG. 3, is provided substantially in the middle of portion 6*a* of load terminal 6**.

The circuit breaker of the present invention further includes a movable contact blade member 20. As shown in FIGS. 1 and 4, contact blade member 20 has a pair of (preferably bevelled) tips 22 which eat in notches 16 of line terminal 4. Contact blade 20 is positioned to pivot about its tips 22. As can be seen in FIG. 4, contact blade 20 also has an opening 24 located on its longitudinal axis. One end 26*a* of a bias spring 26 is disposed in opening 24. The other end 26*b* of spring 26 is secured to leg 8 of line terminal 4. Spring 26 extends through slotted opening 14 in the longer leg 10 of line terminal 4. Spring 26 biases contact blade member 20 in opposite directions as a function of the location of spring end 26*a* relative to a line drawn between the point of engagement of spring end 26*b* with terminal leg 8 (designated A) and the point of contact of contact blade tips 22 in notches 16 (designated B). Contact blade 20 is pivotably biased downward when the thermal breaker is in the contacts-closed position, due to the overcenter position of spring 26. A (preferably circular) electrical contact pad 28 is mounted to contact blade member 20 at the opposite end from pivot tips 22.

The circuit breaker also includes a bimetallic element 30. As shown in FIG. 1, bimetallic element 30 is L-shaped and has a first portion 32 which is mounted to load terminal 6. Bimetallic element 30 also has a second, elongated portion or leg 34 which rests on an insulated sawtooth surface 36 on the inside of housing 2. Sawtooth surface 36 is designed to provide support for bimetallic element 30 with a minimal area of contact. This feature of the present invention prevents housing 2 from acting as a heat sink to bimetallic element 30.

Bimetallic element 30 comprises an upper layer and a lower layer. The lower layer is composed of a metal with a higher coefficient of expansion than the metal of the upper layer. Consequently, when bimetallic element 30 is heated, it bends in an upward direction, as shown in FIG. 5.

Bimetallic element 30 has a (preferably circular) contact pad 38 mounted on the free end of its elongated portion 34. When the circuit breaker is in the contacts closed position, as shown in FIG. 1, pad 38 makes electrical contact with pad 28 of blade member 20.

Optionally, the circuit breaker of the present invention also may include an additional contact pad 40 on contact blade 20, as well as an optional terminal 42. Optional terminal 42 has a somewhat hook-shaped conductor portion 43 at one end, as shown in FIG. 1. Terminal 42 may be connected externally to a separate circuit which may activate, for example, a warning device or alarm.

Optional terminal 42 also functions as a stop to prevent overtravel of contact blade 20. Hence, if an alarm or warning circuit is not required, housing 2 may be designed to include a stop boss, or the equivalent, to replace terminal 42.

The circuit breaker of this invention is preferably intended to be mounted on a printed circuit board (called "PCB"). Computer-aided designed/computer-aided-manufactured ("CAD/CAM") PCB's are standardized with terminal post openings that are spaced apart on multiples of 0.025 inches. Typical CAD/CAM PCB's have their terminal post holes spaced on 0.100 inch centers within a row; adjacent rows are spaced apart on 0.100 inch centers and are offset from each other by 0.050 inch.

Preferably and advantageously, terminals 4, 6 and 42 of the breaker shown in FIG. 1 are spaced from each other by amounts that are multiples of the 0.025 inch CAD/CAM PCB standard. In the embodiment of the breaker shown in FIGS. 1–5, for example, terminals 4 and 6 are spaced apart a distance of 0.400 inch (16 multiples of 0.025 inch); terminals 4 and 42 are spaced apart 0.325 inch (13 multiples of the 0.025 inch PCB standard).

A reset button 44 is provided in housing 2. The upper portion 46 of reset button 44 extends outside the top of housing 2. The lower portion 48 of reset button 44 extends into housing 2 and includes a generally cylindrical shaft 50 and a leg 52 extending from the end of shaft 50. Shaft 50 extends through slotted opening 14 of line terminal 4. Leg 52 is provided with an opening 54. The circuit breaker is assembled so that spring 26 extends through opening 54, as shown in FIG. 1.

In the preferred embodiment, an aperture 56 is located on one end of housing 2, providing access to the bending tab 18 of load terminal 6. The current rating of the circuit breaker (indicative of the current carrying capacity of the breaker) may be adjusted by inserting a pin-type device through aperture 56 and bending tab 18 inward. This action, in turn, pivots bimetallic element 30, in a counterclockwise direction.

In the operation of the circuit breaker, current flows between terminals 4 and 6 via contact blade 20, contacts 28 and 38, and bimetallic element 30. An overcurrent through the breaker causes bimetallic element 30 to heat and bend upwardly, causing blade 20 to pivot in the counterclockwise direction against the bias force of spring 26. When bimetallic element 30 pivots blade 20 upwardly sufficiently to move the contact point of spring end 26*a* and blade 20 (designated C) above the line between points A and B, the direction of spring bias reverses, pivoting blade 20 rapidly in a counterclockwise direction, and thereby opening the breaker with a snap action, as shown in FIG. 5. In the optional configuration shown, contact pad 40 on blade 20 then makes contact with terminal 42 in the contacts-open position, thereby actuating an alarm circuit, or the like.

No current flows through bimetal 30 once the circuit breaker is tripped open. Bimetal 30 thereupon cools and returns to its original position on sawtooth surface 16. Spring 26 continues to bias blade 20 in the counterclockwise direction; the breaker remains open until manually reset. The breaker is reset by a downward movement of reset button 44. Spring 26 is forced downward by leg 52 until engagement point C moves below the line between points A and B. The direction of spring bias force again reverses and urges blade 20 downwardly into contact with bimetal 30. The breaker is thus returned to the contacts closed position.

The breaker may be manually opened by an upward movement of reset button 44, whereby spring 26 is forced upward overcenter.

Figure 7:
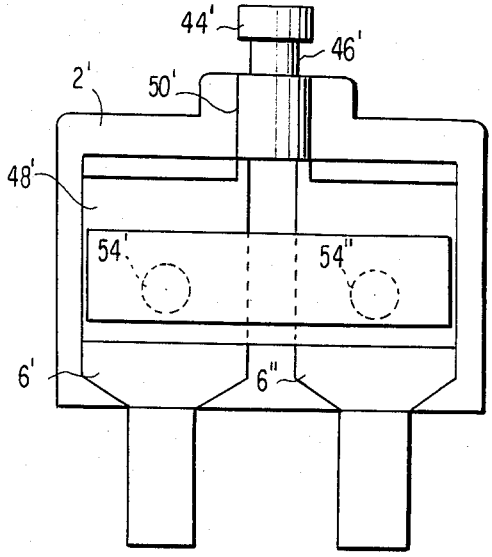
FIG. 7 is an end view of the second embodiment of the invention as a multipole breaker mechanism.

A second embodiment of the invention, shown in FIGS. 6 and 7, provides a multipole breaker mechanism. This embodiment, as shown, includes two thermal breaker mechanisms substantially like the first embodiment and contained in a single housing 2'. In FIGS. 6 and 7, parts corresponding to those of the first embodiment are designated by "'" and "''" marks, respectively. Both of the thermal breaker poles are controlled by a single reset button 44' consisting of a single crossarm 48' and a single cylindrical shaft 50'. Crossarm 48' is provided with two circular openings 54' and 54''. The circuit breaker is assembled so that springs 26' and 26'' extend through openings 54' and 54'', respectively.

In the operation of this embodiment, the opening of either breaker pole (as a result of an overcurrent or by manual upward movement of reset button 44') forces crossarm 48′ up, thereby opening both poles at the same time. Similarly, downward movement of reset button 44′ forces crossarm 48′ down, thereby closing both mechanisms and setting both poles at the same time. It should be apparent that this embodiment is not limited to a two pole breaker mechanism.

Figure 8:
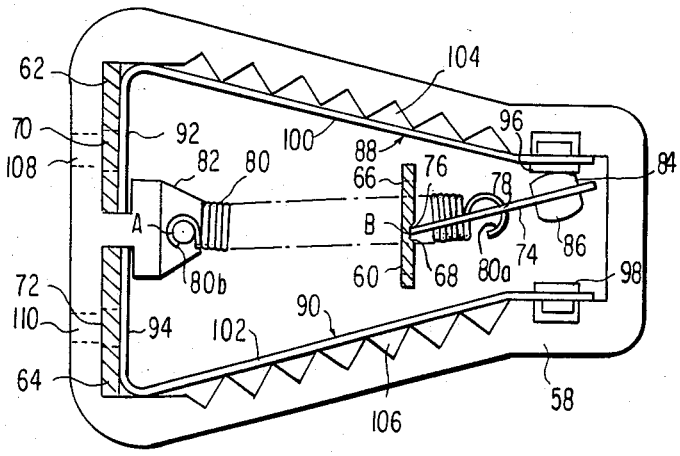
FIG. 8 is a cut-away view of the third embodiment of the invention as a dual contact breaker mechanism.

A third embodiment of the invention, shown in FIG. 8, provides a dual contact breaker mechanism. This embodiment includes a housing 58 of insulating material, wherein a line terminal 60 and two load terminals 62 and 64 are mounted. Line terminal 60 may be located in the center portion of the dual contact thermal breaker.

In the disclosed embodiment, line terminal 60 consists of a portion inside housing 58 with an elongated slotted opening 66, as shown by the dotted lines in FIG. 6. Similar to the first embodiment, line terminal 60 also includes a pair of notches 68 located on opposite sides of slotted opening 66.

Load terminals 62 and 64 are straight conductors. Tabs 70 and 72, similar in shape to tab 18 of the first embodiment, are provided in load terminals 62 and 64 for adjustment of the circuit breaker.

Similar to the configuration of the first embodiment, the dual contact thermal breaker includes a movable contact blade 74. Contact blade 74 has a pair of (preferably beveled) tips 76, which seat in notches 68 of line terminal 60. Contact blade 74 is positioned to pivot about its tips 76. Contact blade 74 also has an opening 78 located on its longitudinal axis. One end 80*a* of a bias spring 80 is disposed in opening 78. The other end 80*b* of spring 80 is secured to an extension 82 of housing 58, as shown in FIG. 8. Spring 80 extends through slotted opening 66 of line terminal 60. Spring 80 biases contact blade 74 in opposite directions as a function of the location of spring end 80*a* relative to a line drawn between the point of engagement of spring end 80*b* with extension 82 (designated A) and the point of contact of tips 76 in notches 68 (designated B). Two contact pads 84 and 86 are mounted on opposite sides of contact blade 74 at the opposite end from pivot tips 76.

The disclosed embodiment also includes a pair of bimetallic elements 88 and 90 which are contoured to the shape of housing 58, as shown in FIG. 8. In a similar manner to the first embodiment, bimetallic elements 88 and 90 have first portions 92 and 94 mounted to respective load terminals 62 and 64. Additionally, contacts 96 and 98 are mounted on the ends of the elongated portions 100 and 102 of bimetallic elements 88 and 90.

Housing 58 includes a pair of sawtooth surfaces 104 and 106 on its inner face. As shown in FIG. 6, bimetallic elements 88 and 90 rest on sawtooth surfaces 104 and 106, respectively, in the absence of an overcurrent. As in the first embodiment of the invention, these surfaces provide support for their corresponding bimetallic element with a minimal area of contact.

Apertures 108 and 110 are provided through the housing adjacent to load terminals 62 and 64. The current ratings of the two breaker mechanisms may be adjusted by inserting a pin-type device through the appropriate aperture 108 or 110 and bending the tab terminal 70 or 72. This action, in turn, pivots corresponding bimetallic element 88 or 90 to provide the desired calibration.

In operation, contact blade 74 rests overcenter on one of the two contacts 96 or 98, thus providing a closed circuit to the corresponding load terminal. An overcurrent through the closed circuit causes the corresponding bimetallic element to deform sufficiently to pivot contact blade 74 over the center of spring 80, and snap over to the contact of the other bimetallic element.

It is apparent from the foregoing that the present invention provides an improved snap action thermal breaker mechanism. The thermal breaker of the present invention provides a faster trip time than prior thermal breakers, due to the quick heating and cooling of the bimetallic unit resulting from a unique set of notches designed in the housing of the unit. Furthermore, due to its compact size, the thermal breaker of the present invention is also better for PC-board mounting with semiconductor elements than prior devices. A second embodiment of the invention provides a multipole circuit breaker which opens all circuits in response to an overcurrent through any one of the circuits. A third embodiment of the present invention provides for switching between two individual circuits by using two separate bimetallic elements.

Figure 9:
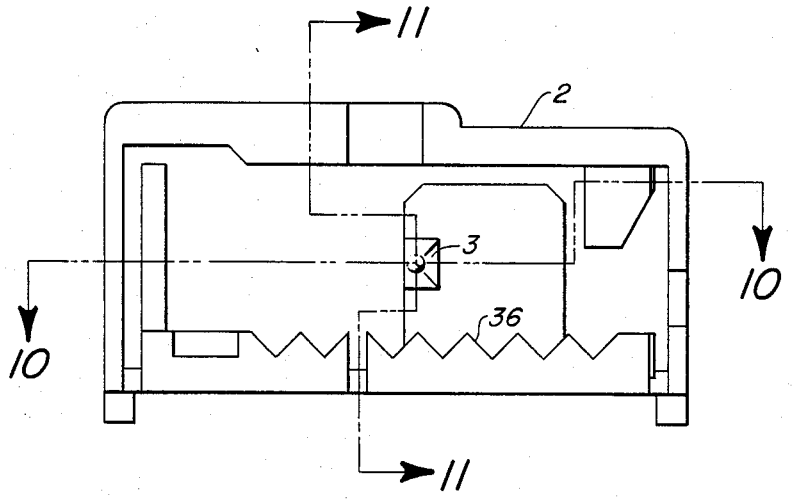
FIG. 9 is a side view of the interior of the breaker case showing additional restraining means.
Figure 10:
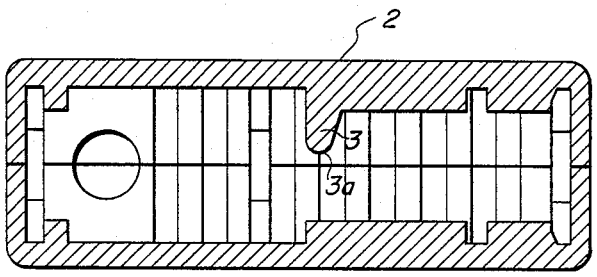
FIG. 10 is a sectional view of the breaker case taken along line 10—10 in FIG. 9.
Figure 11:
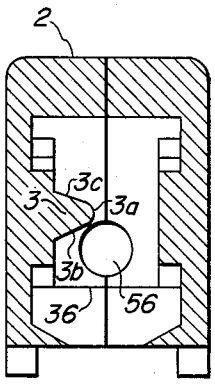
FIG. 11 is a sectional view of the breaker case taken along line 11—11 in FIG. 9.

In a modification of the invention shown in FIGS. 9–11, a stub member 3 extends from an inner wall of housing 2 inwardly so that an end portion 3*a* of stub member 3 overlies a portion of the bias spring 26. As shown in FIG. 11, stub 3 has an upwardly beveled or inclined bottom surface 3*b* and a downwardly beveled or inclined top surface 3*c*. Preferably and advantageously, stub 3 is molded as an integral part of case 2.

In connection with the testing of prototype models of the PC board mounted circuit breaker of this invention, it was found that a sliding action occurs between contact pads 28 and 38. The contact pads 28 and 38 cannot be made perfectly smooth; as the contacts slide over each other, surface variations create variations in the current flow through the breaker contacts. This problem is particularly noticeable during the initial stages of an overcurrent condition, when the bimetallic element 30 begins to heat and bend upwardly relatively slowly. These current variations may adversely affect the operation of the circuit to which the breaker is connected. It must be remembered that the breaker of this invention is designed to operate in the very low current ranges (on the order of 5 A down to 0.5 A or less) associated with computer circuits. Thus, even minor current variations due to contact pad surface discrepancies can cause a relatively large disturbance in the current flow through the associated printed circuit. Stub member 3 provides a simple yet cost effective solution to the sliding contact problem.

In operation, when an overcurrent condition occurs (in the contacts closed position shown in FIG. 1), bimetallic element 30 begins to heat and elongated portion or leg 34 begins to bend upwardly along its length. The upward force exerted by the bending of leg 34 increases until it overcomes the downward force exerted on contact blade 20 by spring 26. In the absence of stub 3, bimetallic leg 34 then begins to urge contact blade 20 upwardly. This causes a relative sliding movement between pads 28 and 38. If the overcurrent is not large, the movement of the leg 34 and blade 20 can occur relatively slowly; this results in the undesirable current variation mentioned above.

However, in the preferred modification shown in FIGS. 9–11, end portion 3*a* of stub member 3 is preferably and advantageously interposed in the upward path of travel of spring 26. Spring 26 is temporarily restrained against upward movement until the upward force exerted by the heated bimetal leg 34 has become sufficiently large to overcome the frictional restraining force imparted to spring 26 by stub end portion 3*a*. The beveled or inclined surface 3*b* of stub member 3 permits spring 26 to slide over and around stub end 3*a* relatively easily when the upward bending force exerted by leg 34 exceeds the downward bias force exerted by spring 26 plus the frictional restraining force exerted by stub 3.

When the upward bending force exceeds the combined downward restraining forces, leg 34 will move upwardly rapidly, quickly forcing contact blade 20 beyond the overcenter position described above. The restraining action imparted by stub end 3*a* directly on spring 26 effectively prevents upward movement of leg 34 (and thus prevents relative sliding movement of contact pads 28 and 38). The subsequent rapid upward movement of leg 34 when the bending force exceeds the combined downward and restraining forces results in a significant decrease in the length of time during which the sliding action between pads 28 and 38 occurs. Variations in the current flow through the contacts due to pad surface discrepancies are therefore minimized and can be effectively disregarded.

The beveled upper surface 3*c* of stub 3 allows spring 26 to easily slide over and around the stub end 3*a* when the reset button 44 is pushed down to close the contacts and reset the breaker, as described above.

Although stub member 3 is shown only in relation to the first described embodiment (FIGS. 1–5), it is clear that one or more restraining stubs may also be used with equal effect in the embodiments shown in FIGS. 6–8. It is also possible to locate the stub 3 so that it exerts a restraining force directly on the bimetallic leg 34 or on the contact blade 20.

In sum, it has been found that it is desirable to provide a means for temporarily restraining the bending action of the bimetallic element and thus the relative sliding movement between contact pads, to thereby minimize the effect of variations in the current flow through the breaker contacts. In the present invention, this is accomplished by a means which requires the bimetallic element to exert a relatively large contacts opening force until a point is reached at which the restraining force is removed quickly and the contacts open rapidly.

The beveled or inclined surfaces 3*b* and 3*c* of stub member 3 permit leg 34 to slide over and around stub end 3*a* relatively easily when the bending force (either upward or downward) on leg 34 exceeds the restraining force exerted by stub 3.

The invention may be embodied in other specific forms without departing from the spirit or essential characteristics thereof. The present embodiments are, therefore, to be considered in all respects as illustrative and not restrictive, the scope of the invention being limited by the appended claims rather than by the foregoing description, and all changes which come within the meaning and range of equivalency of the claims are, therefore, intended to be embraced therein.

What is claimed is:

1. A circuit breaker, comprising:

an electrically insulated housing;

first, second, and third terminal means extending through said housing, wherein said first terminal is connected to a first electrical circuit and said second terminal is connected to a second electrical circuit;

a first bimetallic element located in said housing and electrically coupled to said first terminal;

a first contact member coupled to said first bimetallic element;

a second bimetallic element located in said housing and electrically coupled to said second terminal;

a second contact member coupled to said second bimetallic element;

a third contact member located in said housing and electrically coupled to said third terminal;

means mounting said third contact member for movement alternately into and out of contact with said first and second contact members, respectively; and means biasing said third contact member substantially through the center of movement of said third contact member to alternately bias said third contact member in opposite pivotal directions between first and second positions, wherein in said first position, said third contact member is biased into electrical contact with said first contact member, and in said second position, said third contact member is biased into electrical contact with said second contact member;

said first bimetallic element being deformed upon application of a sufficient overcurrent therethrough against the action of said biasing means to move said third contact member from said first position toward said second position; and said second bimetallic element being deformed upon application of a sufficient overcurrent therethrough against the action of said biasing means to move said third contact member from said second position toward said first position.

2. Apparatus according to claim 1, wherein said electrically insulated housing of said circuit breaker includes a sawtooth surface around its inner perimeter, upon which said first and second bimetallic element alternately rest when said circuit breaker is in said first and second positions, respectively.

3. Apparatus according to claim 1, wherein said housing further includes means for providing access to said first and second terminals for adjustment of the trip ratings of said first and second contact members, respectively.

4. A multipole circuit breaker, comprising:

an electrically insulated housing;

a plurality of pole units in said housing, each pole unit having substantially the same breaker mechanism, and each breaker mechanism comprising:

first and second terminal means extending through said housing for connecting the breaker to an electrical circuit;

a bimetallic element located in said housing and electrically coupled to said first terminal;

a first contact member coupled to said bimetallic element;

a second contact member located in said housing and electrically coupled to said second terminal;

means mounting said second contact member for movement into and out of contact with said first contact member; and means biasing said second contact member substantially through the center of movement of said second contact member to alternately bias said second contact member in opposite directions between first and second positions, wherein in said first position, said second contact member is biased into electrical contact with said first contact member, and in said second position, said second contact member is biased out of electrical contact with said first contact member;

said bimetallic element being deformed upon application of a sufficient overcurrent therethrough to move said second contact member from said first position toward said second position against the action of said biasing means;

said multipole breaker further comprising:

a common reset means coupled to each of said plurality of breaker mechanism and operable to return all of said second contact members to said first position when said second contact members are in said second position.

5. Apparatus according to claim 4, further comprising means coupling said reset means in common to all of said breaker mechanisms to move all of said second contact members from said first position to said second position upon application of a sufficient overcurrent through any of said breaker mechanisms.

6. Apparatus according to claim 4, wherein said circuit breaker further comprises reset means operable to return said second contact member to said first position from said second position, said reset means including a reset member extending into said housing and being movable therein, said reset member having a plurality of openings therein through which each of said biasing means passes, said reset member and said biasing means engaging each other to move each of said second contact members between said first and second positions substantially concurrently.

7. A circuit breaker, comprising:

an electrically insulating housing having a sawtooth surface formed in the lower portion thereof;

first and second terminal means extending through said housing for connecting the breaker to an electrical circuit;

a bimetallic element located in said housing and electrically coupled to said first terminal, wherein said bimetallic element rests on said sawtooth surface when not in a deformed state;

a first contact member coupled to said bimetallic element;

a second contact member located in said housing and electrically coupled to said second terminal;

means for mounting said second contact member for movement into and out of contact with said first contact member; and biasing means coupled to said second contact member to alternately bias said second contact member in opposite directions between first and second positions, wherein in said first position, said second contact member is biased into electrical contact with said first contact member, and in said second position, said second contact member is biased out of electrical contact with said first contact member;

said bimetallic element being deformed upon application of a sufficient overcurrent therethrough to move said second contact member from said first position toward said second position against the action of said biasing means.

8. A circuit breaker, comprising:

an electrically insulating housing;

first and second terminal means extending through said housing for connecting the breaker to an electrical circuit;

a bimetallic element located in said housing and electrically coupled to said first terminal;

a first contact member coupled to said bimetallic element;

means for providing access through said housing to said first terminal for adjustment of the first contact member, to thereby adjust the trip rating of said breaker;

a second contact member located in said housing and electrically coupled to said second terminal;

means for mounting said second contact member for movement into and out of contact with said first contact member; and biasing means coupled to said second contact member to alternately bias said second contact member in opposite directions between first and second positions, wherein in said first position, said second contact member is biased into electrical contact with said first contact member, and in said second position, said second contact member is biased out of electrical contact with said first contact member;

said bimetallic element being deformed upon application of a sufficient overcurrent therethrough to move said second contact member from said first position toward said second position against the action of said biasing means.

9. A circuit breaker, as recited in claim 8, wherein said first terminal includes a bendable tap on the housed portion thereof.

10. A circuit breaker, as recited in claim 9, wherein said bimetallic element is L-shaped, having a first portion and a second portion, wherein said first portion abuts said bendable tab of said first terminal.

11. A circuit breaker, comprising:

an electrically insulating housing;

first and second terminal means extending through said housing for connecting the breaker to an electrical circuit;

a bimetallic element located in said housing and electrically coupled to said first terminal;

a first contact member coupled to said bimetallic element;

a second contact member located in said housing and electrically coupled to said second terminal;

means for mounting said second contact member for movement into and out of contact with said first contact member, wherein said mounting means comprises a blade member with an opening located along the longitudinal axis thereof; and bias means comprising an overcenter spring having one end portion coupled to said second terminal and a second end portion coupled to said blade member to alternately bias said second contact member in opposite directions between first and second positions, wherein in said first position, said second contact member is biased into electrical contact with said first contact member, and in said second position, said second contact member is biased out of electrical contact with said first contact member;

said bimetallic element being deformed upon application of a sufficient overcurrent therethrough to move said second contact member from said first position toward said second position against the action of said biasing means.

12. A circuit breaker, as recited in claim 8 or 11, wherein said circuit breaker housing includes a sawtooth surface in the lower portion of said housing, upon which said bimetallic element rests when not in a deformed state.

13. A circuit breaker, as recited in claim 8 or 11, wherein said circuit breaker further comprises reset means operable to return said second contact member to said first position from said second position, said reset means including a reset member extending into said housing and being movable therein, and wherein said reset member engages said biasing means to move said second contact member between said first and second positions.

14. A circuit breaker, as recited in claim 13, wherein said reset member has an opening therein through which said biasing means passes.

15. A circuit breaker, comprising:

an electrically insulating housing having a sawtooth surface formed in the lower portion thereof;

first and second terminal means through said housing for connecting the breaker to an electrical circuit, said first terminal means including a housed portion and an outside portion, wherein said housed portion includes a bendable tab;

a first contact member;

means for providing access through said housing to said first terminal, adjacent said bendable tab, for adjustment of said first contact member to thereby adjust the trip rating of said breaker;

a second contact member located in said housing and electrically coupled to said second terminal;

means for mounting said second contact member for movement into and out of contact with said first contact member, wherein said mounting means comprises a blade with an opening located along the longitudinal axis thereof;

biasing means comprising an overcenter spring, having one end coupled to said second terminal, and its other end coupled to said blade member through said opening to alternately bias said second contact member in opposite directions between first and second positions, wherein in said first position, said second contact member is biased into electrical contact with said first contact member, and in said second position, said second contact member is biased out of electrical contact with said first contact member;

a bimetallic element located in said housing and coupled to said first contact member and electrically coupled to said first terminal, said bimetallic element having a first portion and a second portion, wherein said first portion abuts said bendable tab and said second portion rests on said sawtooth surface when not in a deformed state, said bimetallic element being deformed upon application of a sufficient overcurrent therethrough to move said second contact member from said first position toward said second position against the action of said biasing means; and reset means for resetting said second contact, said reset means being operable to return said second contact member to said first position when said second contact member is in said second position.

16. A circuit breaker, as recited in claim 15, wherein said reset means includes a reset member extending into said housing and being movable therein, said reset member having an opening therein through which said biasing means passes, said reset member and said biasing means engaging each other to move said second contact member between said first and second positions.

17. A circuit breaker, as recited in claim 7, 8, 11 or 15, further comprising means for exerting a restraining force to inhibit deformation of said bimetallic element until the deforming force on said element exceeds said restraining force and releases said bimetallic element to move said second contact member toward said second position.

18. A circuit breaker as recited in claim 17, wherein said means for exerting said restraining force comprising a stub member extending from an inner wall of said housing inwardly to and into the path of movement of said bias means to inhibit movement of said bias means.

19. A circuit breaker, as recited in claim 7, 8, 11, or 15, wherein said first and second terminal means are spaced apart from each other a distance that is an integer multiple of 0.025" to permit mounting said circuit breaker to a printed circuit board made by computer-aided design techniques.

20. A circuit breaker, comprising:

an electrically insulating housing;

first, second and third terminal means extending through said housing for connecting the breaker to an electrical circuit;

a bimetallic element located in said housing and electrically coupled to said first terminal;

a first contact member coupled to said bimetallic element;

a second contact member located in said housing and electrically coupled to said second terminal;

a third contact member in said housing and electrically coupled to said third terminal;

means for mounting said second contact member for movement into and out of contact with said first and third contact members; and biasing means coupled to said second contact member to alternately bias said second contact member in opposite directions between first and second positions, wherein in said first position, said second contact member is biased into electrical contact with said first contact member, and in said second position, said second contact member is biased into electrical contact with said third contact member;

said bimetallic element being deformed upon application of a sufficient overcurrent therethrough to move said second contact member from said first position toward said second position against the action of said biasing means.

21. A circuit breaker, as recited in claim 20, wherein said first, second and third terminal means are spaced from each other by amounts that are integer multiples of 0.025" to permit mounting said circuit breaker to a printed circuit board made by computer-aided design techniques.

22. A circuit breaker, comprising:

an electrically insulating housing;

first and second terminal means extending through said housing for connecting the breaker to an electrical circuit;

a bimetallic element located in said housing and electrically coupled to said first terminal;

a first contact member coupled to said bimetallic element;

a second contact member located in said housing and electrically coupled to said second terminal;

means for mounting said second contact member for movement into and out of contact with said first contact member;

biasing means coupled to said second contact member to alternately bias said second contact member in opposite directions between first and second positions, wherein in said first position, said second contact member is biased into electrical contact with said first contact member, and in said second position, said second contact member is biased out of electrical contact with said first contact member;

said bimetallic element being deformed upon application of a sufficient overcurrent therethrough to move said second contact member from said first position toward said second position against the action of said biasing means; and means for exerting a restraining force to inhibit deformation of said bimetallic element until the deforming force on said element exceeds said restraining force and releases said bimetallic element to move said second contact member toward said second position.

23. A circuit breaker as recited in claim 22, wherein said means for exerting said restraining force comprises a stub member extending from an inner wall of said housing inwardly to and into the path of movement of said bias means to inhibit movement of said bias means.

24. A circuit breaker, as recited in claim 22, wherein said circuit breaker housing includes a sawtooth surface in the lower portion of said housing, upon which said bimetallic element rests when not in a deformed state.

25. A circuit breaker, as recited in claim 22, wherein said mounting means comprises a blade member with an opening located along the longitudinal axis thereof; and said bias means comprises an overcenter spring, wherein one portion of said overcenter spring is coupled to said second terminal, and the other end portion of said overcenter spring is coupled to said mounting means through said opening.

26. A circuit breaker, as recited in claim 22 or 25, further comprising third terminal means extending through said housing for connection to an electrical circuit and a third contact member in said housing electrically coupled to said third terminal; wherein said second contact member is biased into electrical contact with said third contact member when said second contact member is in said second position.

27. A circuit breaker, as recited in claim 26, wherein said circuit breaker further comprises reset means operable to return said second contact member to said first position from said second position, said reset means including a reset member extending into said housing and being movable therein, and wherein said reset member engages said biasing means to move said second contact member between said first and second positions.

28. A circuit breaker, as recited in claim 27, wherein said reset member has an opening therein through which said biasing means passes.

* * * * *

REEXAMINATION CERTIFICATE (1402nd)

United States Patent [19]

Merchant

[11] B1 4,510,479

[45] Certificate Issued Jan. 8, 1991

[54] PC-BOARD MOUNTED THERMAL BREAKER

[75] Inventor: Donald K. Merchant, Cambridge, Md.

[73] Assignee: Airpax Corp., Cambridge, Md.

Reexamination Request:
No. 90/001,875, Oct. 31, 1989

Reexamination Certificate for:

| | |
|---|---|
| Patent No.: | **4,510,479** |
| Issued: | **Apr. 9, 1985** |
| Appl. No.: | **550,462** |
| Filed: | **Nov. 10, 1983** |

Related U.S. Application Data

[63] Continuation-in-part of Ser. No. 480,285, Mar. 30, 1983, abandoned.

[51] Int. Cl.[5] ..... H01H 61/00; H01H 71/16

[52] U.S. Cl. ..... 337/91; 337/56; 337/66; 337/372

[58] Field of Search ..... 337/66, 89, 91, 94, 337/365, 367, 368, 372, 56

[56] References Cited

U.S. PATENT DOCUMENTS 3,176,098 3/1965 Watson .
4,157,524 6/1979 Lamarche ..... 337/68

FOREIGN PATENT DOCUMENTS 24041 3/1981 Japan .
245150 12/1925 United Kingdom .

OTHER PUBLICATIONS

Electric Production, France, Jan. 1979, p. 2.

*Primary Examiner*—Harold Broome

[57] ABSTRACT

A PC-board mounted thermal breaker that opens with a snap action is disclosed. A bimetallic element, connected to the load terminal of the thermal breaker, rests on an insulated sawtooth surface when the breaker is in the closed position. A contact blade, connected to the line terminal of the breaker, is pivotably biased downward into electrical contact with the bimetallic element by the action of an overcenter spring. An overcurrent through the breaker heats the bimetallic element directly and causes it to bend upwardly, forcing the contact blade to pivot against the bias of the spring. When the contact blade has pivoted sufficiently to move the spring overcenter, the direction of spring bias reverses, pivoting the contact blade rapidly upward, and thereby opening the breaker with a snap action.

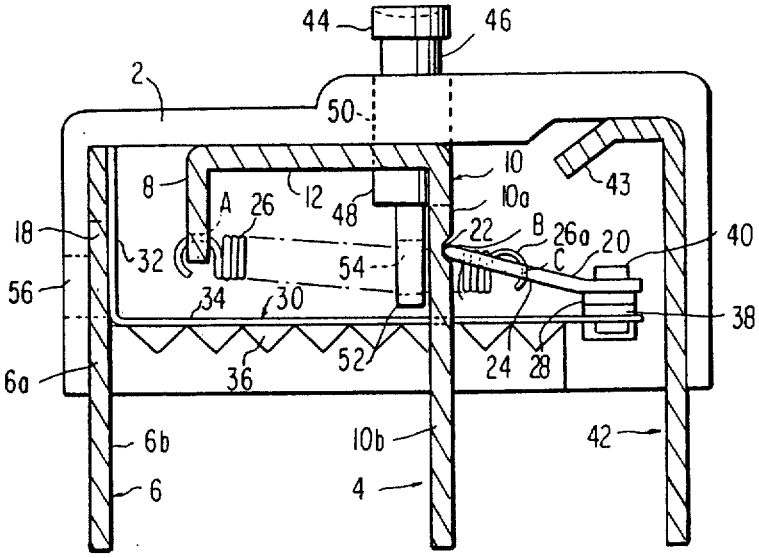

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-28 is confirmed.

* * * * *